United States Patent [19]

Leuthold

[11] 4,371,119

[45] Feb. 1, 1983

[54] AGITATOR-TYPE BALL MILL

[75] Inventor: Albert Leuthold, Basel, Switzerland

[73] Assignee: Willy A. Bachofen AG, Basel, Switzerland

[21] Appl. No.: 111,992

[22] Filed: Jan. 14, 1980

[30] Foreign Application Priority Data

Jan. 18, 1979 [CH] Switzerland ..... 477/79

[51] Int. Cl.[3] ..... B02C 17/18

[52] U.S. Cl. ..... 241/66; 165/38; 241/179; 241/DIG. 30

[58] Field of Search ..... 241/65, 66, 67, 171, 241/174, 179, 180, 182, DIG. 30

[56] References Cited

U.S. PATENT DOCUMENTS 4,078,731 3/1978 Pujol ..... 241/65

4,174,074 11/1979 Geiger ..... 241/67 X

*Primary Examiner*—Mark Rosenbaum

*Assistant Examiner*—Timothy V. Eley

*Attorney, Agent, or Firm*—Michael J. Striker

[57] ABSTRACT

An agitator-type ball mill has a circumferential wall which bounds a working chamber having an axis and includes two radially spaced jackets which form therebetween a gap for receiving a heat-exchange medium. The jackets are releasably connected with one another so that they can be separated from each other by displacement in an axial direction. A flexible member is arranged in the gap between the jackets, connected with one of the jackets, and forms a substantially helical passage in the gap. The heat exchange medium flows through the thus-formed helical gap. The flexible member may be formed by a band which is inserted in a helical groove provided in one jacket and extends radially into the gap so as to abut against the other jacket with prestress.

18 Claims, 3 Drawing Figures

AGITATOR-TYPE BALL MILL

BACKGROUND OF THE INVENTION

The present invention relates to an agitator-type ball mill. More particularly, it relates to an agitator-type ball mill which has a working or milling chamber bounded by a wall having an inner jacket, an outer jacket, and a helical passage for receiving a cooling or heating medium formed between the jackets.

Agitator-type ball mills of the above-mentioned general type are known in the art. One jacket of a known mill is provided with a helical groove in which a band laterally bounding the passage between the jackets is inserted. One such construction is disclosed in the German Offenlegungsschrift No. 2,634,835. The agitator-type ball mill has a working or milling chamber with a wall formed by a metallic inner jacket and a metallic outer jacket. Both jackets are welded at both ends to a flange. An intermediate space is provided between the jackets, and a helical groove of a rectangular cross section is formed on the outer surface of the inner jacket. A band havinng a rectangular cross section and constituted of metal is inserted in the groove. The ends of the band are welded to the inner jacket. The outer rectangular portion of the band abuts against the outer jacket so that a helical passage for receiving a cooling or heating medium is formed between the jackets and the band. The band has a width, measured in the axial direction of the working chamber, which is substantially equal to the radial dimension of the intermediate space between the jackets. Thereby, the band, after its insertion into the intermediate passage, is practically completely rigid.

Town water is generally utilized as a cooling or heating medium during the operation of the agitator-type ball mill. Since this water generally contains impurities, minerals, and dissolved salt, deposits, particularly of lime, are formed in the passage between the jackets, and the band. These deposits can clog the passage so that is can no longer perform its intended functions. Since both jackets are fixedly welded with one another, it is generally impossible to clean the passage without destruction of the chamber wall. Thereby, when the helical passage is clogged, the entire wall of the mill must be exchanged.

The above-mentioned German Offenlegungschrift also described an example in which both jackets are releasably connected with one another. The lateral limiting of the passage for the cooling medium is, however, attained not by a band insertable in a groove of a jacket, but by a rib of the inner or outer jacket. It has been shown, that even though the both jackets are releasably connected with one another, the clogging of the passage makes impossible separation of the inner and outer jackets from one another in the known agitator-type ball mills without destruction. The deposits which take place in the passage connect the rib provided on the one jacket, with the other jacket so firmly that separation of the jackets is no longer possible.

SUMMARY OF THE INVENTION

Accordingly, it is an object of the present invention to provide an agitator-type ball mill which avoids the disadvantages of the prior art.

More particularly, it is an object of the present invention to provide an agitator-type ball mill in which deposits formed in a passage for receiving heat exchange medium can be removed without destruction of the jackets forming the wall of the working chamber.

In keeping with these objects and with others which will become apparent hereinafter, one feature of the present invention resides, briefly stated, in an agitator-type ball mill in which the jackets are so connected with one another that they can be separated from each other by displacement in an axial direction, and a member forming a helical passage in a gap between the jackets is connected with one of the jackets and is flexible. The flexible member may be formed by a flexible band which is inserted in a helical grooves of the one jacket.

The flexible band may have a modulus of elasticity at most equal to 200,000 N/cm$^2$. The band may be constituted of elastic rubber. A second radial portion of the flexible member which extends in the gap between the jackets may have a width in the axial direction which is at most equal to one-third of the radial dimension of the gap. On the other hand, the width of the second radial portion of the flexible member may be smaller than the width of a first radial portion inserted in the helical groove of the one jacket. The flexible member may abut against the other of the jackets with prestress.

The helical groove of the one jacket and the first radial portion of the flexible member may have a dovetailed cross section. The helical groove may be formed in the radially outer jacket so that the flexible member is inserted in the groove of the radially outer jacket and abut with prestress against the radially inner jacket. The radially inner jacket may include a metal shell and a protective layer which radially inwardly coats the metal shell and may be constituted of hard rubber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF PREFERRED EMBODIMENTS

Figure 1:
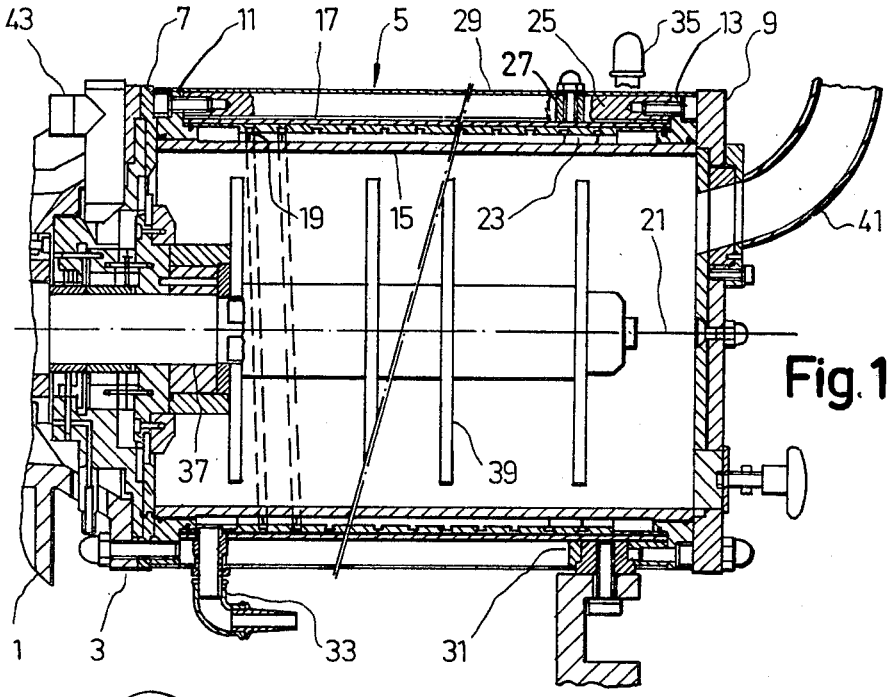
FIG. 1 is a view showing a longitudinal section of an agitator-type ball mill in accordance with the present invention.

An agitator-type ball mill is illustrated in FIG. 1 and has a frame or support 1 which is shown only partially and provided with a flange 3. A working or milling chamber which is identified by reference numeral 5 is releasably mounted on the support 1 and more particularly on the flange 3 of the support 1.

The working chamber is limited at its left end in FIG. 1 by a flange 7 which is composed of several rings and fixedly screwed to the flange 3. The working chamber at its right end in FIG. 1 is similarly provided with a flange 9 composed of several parts. Rings 11 and 13 are fixedly screwed on the flanges 7 and 9, and more particularly at the sides of the latter which face toward one another.

Figure 2:
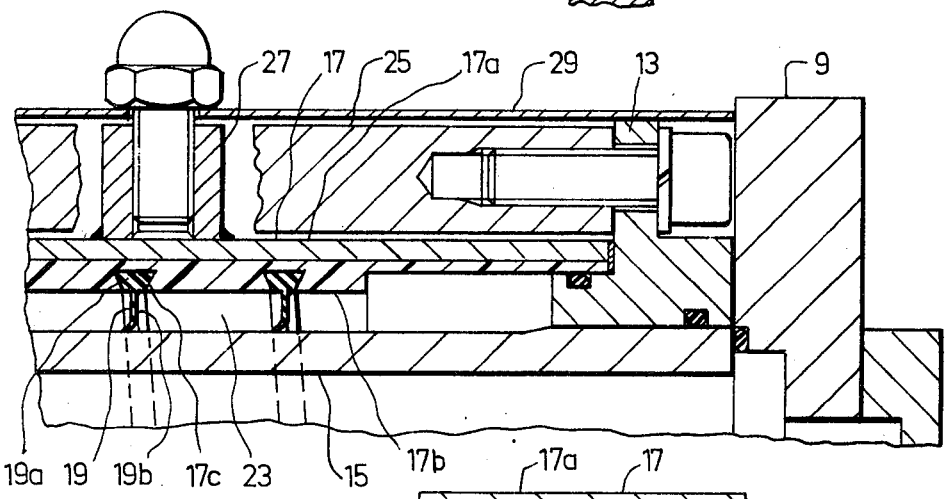
FIG. 2 is a view showing an enlarged fragment of the mill shown in FIG. 1.

The working chamber 5 has a wall which includes a cylindrical inner jacket 15, and a cylindrical outer jacket 17 which is coaxial with the inner jacket 15. The inner jacket 15 is constituted of rust-proof steel. As can be seen from FIG. 1 and particularly from FIG. 2 in which the right end of the inner jacket is shown, the inner jacket 15 has end faces which rest on the flanges 7 and 9, and an outer face having end portions which lie on the inner face of the rings 11 and 13. The faces which contact one another are sealed by sealing rings.

The outer jacket 17 abuts against a shoulder of the rings 11 and 13, and the abutment faces are sealed by sealing rings. An intermediate space formed as an annular gap is provided between both jackets 15 and 17. The outer jacket 17 is composed of an outer metallic shell 17*a* which is inwardly coated by a layer of hard rubber 17*b*. An annular groove 17*c* having a dove-tailed cross section extends along a helix about an axis 21 of the working chamber 5 and is formed in the hard rubber layer 17*b*.

Figure 3:
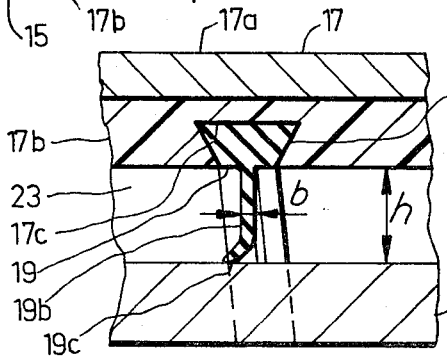
FIG. 3 is a view showing an enlarged fragment of the mill shown in FIG. 2.

A member 19 which is shown only partially in FIG. 1 is inserted in the groove 17*c*. The member 19 is formed as a band of elastic material, for example of synthetic plastic material. As can be seen particularly from FIG. 3, the band 19 has a portion 19*a* which is located in the groove 17*c* has a dove-tailed cross section complementary to the groove. The band has a further portion 19*b* which forms a lip extending approximately radially to the axis 21 and projecting outwardly of the groove 17*c*.

The portion 19*b* of the band 19 in free condition, that is before assembling of the jackets 15 and 17, extends completely radially to the axis 21 and has a radial dimension which is somewhat greater than the radial dimension h of the intermediate space between the jackets 15 and 17. When the jackets 15 and 17 are fitted over one another during mounting, a free edge 19*c* of the portion 19*b* bends in accordance with the direction of axial displacement of the jackets, for example to the left in FIGS. 1–3. The bent-off edge 19*c* abuts with elastic prestress on the outer face of the inner jacket 15.

The width b of the portion 19*b*, which is measured in the direction normal to a radius extending through the band 19 and substantially parallel to the axis 21, is smaller than the width of the groove 17*c* and thereby than the width of the portion 19*a* inserted in this groove. This width b amounts to at most one-third of the dimension h of the intermediate space measured in the direction along the abovementioned radius. The band portion 19*b* is thereby relatively highly flexible. The band 19 forms together with the proximal faces of the jackets 15 and 17 a helically extending passage 23.

The rings 11 and 13 are mounted outside of the outer jacket 17 on a rim of bars one of which is shown and identified by reference numeral 25. The mounting is performed by screws, and the rings 11 and 13 are connected with one another via these bars. Spacers 27 are welded to the outer jacket 17. A protective jacket 29 is releasably mounted by screws on the spacers 27 or fixed by rivets. A holding ring 31 located in the region of the right end of the working chamber and composed of several parts, releasably mounts the working chamber 5 on the support 1. An inlet pipe 33 is provided in the region of the left lower end of the wall of the working chamber and opens into an inlet part of the passage 23 in the intermediate space between the jackets 15 and 17. An outlet portion of the passage 23 communicates with an outlet pipe 35 which extends through the outer jacket 17.

A drive shaft 37 is rotatably mounted in the support 1 and extends coaxially to the axis 21 of the working chamber. An agitating or steering organ 39 is mounted on the drive shaft in the interior of the working chamber 5. During the operation, the agitating organ rotates and moves balls which are located in the interior of the chamber. A material to be milled or ground can be introduced through an inlet pipe 41 mounted on the flange 9, and withdrawn after the termination of the process through an outlet pipe 43.

During the operation of the agitator-type ball mill, heat is liberated because of the friction of the balls and the comminution of the material to be milled, in presence of, for example, a bacteria containing liquids. In order to withdraw this heat, cold town water under small excess pressure is conveyed through the passage 23. The water is introduced into the passage 23 through the inlet pipe 33 and withdrawn from the same through the outlet pipe 35. The pressure drop which takes place between the successive coils of the passage 23 from the left to the right, acts upon the portion 19*c* of the band 19 so that it is additionally urged toward the inner jacket 15.

During the operation, solid material and dissolved salt contained in water tend to make deposits in the passage 23. They can form particularly a lime deposit. The deposited material retards the flow of water, reduces the heat exchange, and can lead to complete clogging of the passage 23. In order to remove such deposits, it is possible from time to time to convey through the passage 23 a flow medium under relatively high pressure in the direction which is opposite to the direction of flow of water during the normal operation, that is in the direction from the right to the left in FIGS. 1–3. The thus obtained pressure drop has the tendency to lift the edge 19*c* of the band 19 from the inner jacket 15. This is sufficient to loosen and destroy the deposit, so that the deposited material can be washed out of the passage 23.

When this process is not sufficient in order to clean the passage 23, the flange 9 can be unscrewed from the ring 13 and the latter can be unscrewed from the bars 25, so that the protective jacket 29 is removed and the entire wall of the chamber is dismounted. It is especially possible to displace the inner jacket 15 and the outer jacket 17 from one another in the direction of the axis 21 of the chamber and separate the jackets from each other. When the band 19 and the proximal faces of the jackets 15 and 17 are encrusted by a firm compact deposit, the flexibility of the band 19 allows the separation of the jackets 15 and 17 from one another. After this, the jackets and the band can be cleaned mechanically or with the aid of a solvent medium. If the band 19 is damaged during the mounting or cleaning, it can be replaced with relatively low cost. Then, the wall can be again assembled.

The agitator-type ball mill can be modified in different respects. For example, the inner and outer jackets may be connected with one another in different ways. Further, instead of one passage 23, two or more passages formed by one-thread or multiple-thread helices may be provided. Furthermore, the outer jackets may be constituted of a hard synthetic plastic material or of a corrosion resistant metal.

The inner jacket may be constituted, instead of rust-proof steel, for example of brass, glass or other materials. It is recommended to select a material which is resistant both to the material to be milled and to the cooling medium, and also has best possible heat exchange properties.

The band which forms the helical passage may be constituted not of a synthetic rubber elastic material, but of natural coautchouc or a mixture of natural and synthetic caoutchouc.

It is advantageous when the band is constituted of a rubber elastic material whose modulus of elasticity is equal to between 100 and 1000 N/cm$^2$. Band materials with an elastic modulus to 10,000 N/cm$^2$, such as for example bands of soft polyvinylchloride, are also suitable. For certain applications even more flexible bands of polyamide or polyethylene or other synthetic plastic materials with a modulus of elasticity to a maximum value of approximately 200,000 N/cm$^2$ can be utilized.

In some cases it is necessary to heat the working chamber. In this case, it is possible to convey through the passage 23 a heating medium instead of the cooling medium. Hot water can be utilized for example as the heating medium.

It will be understood that each of the elements described above, or two or more together, may also find a useful application in other types of constructions differing from the types described above.

While the invention has been illustrated and described as embodied in an agitator-type ball mill, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An agitator-type ball mill, comprising a circumferential wall which bounds a working chamber having an axis, said wall including two radially spaced jackets which form therebetween a gap in which a heat-exchange and a cleaning medium can be received and in which a deposit of foreign material tends to form; means for releasably connecting said jackets with one another and arranged so that said jackets can be separated from each other by displacement in an axial direction; and means for forming a substantially helical passage in said gap including a member which is connected with one of said jackets and extends in said gap to the other of said jackets, said member being elastic and shaped so that when the heat-exchange medium is supplied into said gap in one axial direction said member due to the elasticity of said member abuts against said other jacket and thereby maintains said helical passage, whereas when a cleaning medium is supplied in said gap in another axial direction which is opposite to said one direction said cleaning medium lifts said member from said other jacket thereby facilitating removal of the foreign material deposits.

2. An agitator-type ball mill as defined in claim 1, wherein said one jacket is provided with a helical groove with a bottom and a cross section increasing toward said bottom, said member being releasably inserted in said groove.

3. An agitator-type ball mill as defined in claim 1, wherein said one jacket is provided at its side facing the other jacket with a smooth cylindrical surface portion and a helical groove for inserting said member and arranged so that its edges are disposed in said surface portion.

4. An agitator-type ball mill as defined in claim 1, wherein said band has a modulus of elasticity at most equal to 10,000 N/cm$^2$.

5. An agitator-type ball mill as defined in claim 1, wherein said band has a modulus of elasticity at most equal to 1,000 N/cm$^2$.

6. An agitator type ball mill as defined in claim 1, wherein said flexible member is a flexible band.

7. An agitator-type ball mill as defined in claim 6, wherein said band has a modulus of elasticity at most equal to 200,000 (N/cm$^2$).

8. An agitator type ball mill as defined in claim 6, wherein said band is constituted of elastic rubber.

9. An agitator type ball mill as defined in claim 1, wherein said jackets are coaxial to said inner chamber and concentric relative to one another.

10. An agitator-type ball unit as defined in claim 1, wherein said one jacket is provided with a helical groove, said flexible member having a first radial portion which is inserted in said helical groove and formed substantially complementary to the latter, and a second radial portion which extends substantially radially from said first radial portion into said gap and to said other jacket.

11. An agitator-type ball mill as defined in claim 10, wherein said gap between said jackets has a predetermined radial dimension, said second radial portion of said flexible member having a width measured in the axial direction and at most equal to one third of said radial dimension of said gap.

12. An agitator-type ball mill as defined in claim 10, wherein said first radial portion of said flexible member has a predetermined width measured in the axial direction, said second radial portion of said flexible member having a width which is measured in the axial direction and is smaller than the width of said first radial portion.

13. An agitator-type ball mill as defined in claim 10, wherein said helical groove and said first radial portion of said flexible member inserted in said helical groove have a dovetailed cross section.

14. An agitator-type ball mill as defined in claim 1, wherein said flexible member abuts against the other of said jackets with prestress.

15. An agitator-type ball mill as defined in claim 10, wherein said jackets include a radially outer jacket and a radially inner jacket, said helical groove being provided in said radially outer jacket so that said flexible member is connected with the latter.

16. An agitator-type ball mill as defined in claim 1, wherein one of said jackets includes a metal shell and a protective layer which coats said metal shell.

17. An agitator-type ball mill as defined in claim 16, wherein said protective layer is constituted of hard rubber.

18. An agitator-type ball mill as defined in claim 16, wherein said protective layer of said one jacket is provided with a helical groove completely confined in said protective layer, said member being inserted in said helical groove.

* * * * *